US005333742A

United States Patent [19]

Piedmont et al.

[11] Patent Number: 5,333,742

[45] Date of Patent: Aug. 2, 1994

[54] MODIFIED SANITARY TOOTHBRUSH HOLDER

[76] Inventors: Gregory H. Piedmont, 13792 Old Hwy. 80, #44, El Cajon, Calif. 92021; George Spector, 233 Broadway, Rm. 702, New York, N.Y. 10279

[21] Appl. No.: 79,451

[22] Filed: Jun. 21, 1993

[51] Int. Cl.[5] ..... A47B 81/02

[52] U.S. Cl. ..... 211/65; 211/12; 248/110; 248/95; 206/209.1; 206/390; 206/362.1; 206/362.3; 221/63; 225/42; 242/598

[58] Field of Search ..... 211/65, 59.2, 12; 206/209.1, 390, 362.1, 362.2, 362.3; 248/110, 95; 221/25, 63; 225/42, 77, 106; 242/55.3, 55.53, 76, 106

[56] References Cited

U.S. PATENT DOCUMENTS

| | | | |
|---|---|---|---|
| 2,031,115 | 2/1936 | Lindbloom et al. | 206/362.3 |
| 2,366,876 | 1/1945 | Ross | 206/209.1 |
| 2,655,968 | 10/1953 | Simmons | 206/362.3 X |
| 4,364,490 | 12/1982 | Lang et al. | 206/390 |
| 4,793,539 | 12/1988 | Haenni et al. | 221/63 |
| 4,955,505 | 9/1990 | Battaglia | 206/390 |
| 4,995,509 | 2/1991 | Kornfeind | 206/352.3 X |
| 5,109,978 | 5/1992 | Cawley | 206/390 X |
| 5,139,142 | 8/1992 | Simon | 206/362.3 |
| 5,207,368 | 5/1993 | Wilfong, Jr. et al. | 206/390 X |

*Primary Examiner*—David A. Scherbel
*Assistant Examiner*—Korie H. Chan

[57] ABSTRACT

A sanitary toothbrush holder is provided, which consists of a plate for mounting the holder to a flat vertical surface. A bracket extends outwardly from the plate, while a receptacle is formed on a forward end of the bracket. A roll of sanitary disposable plastic bags is rotatably carried in the bracket. The leading bag can be opened and positioned manually within the receptacle to receive a bristle head of a toothbrush. When the leading bag with the bristle head of the toothbrush is removed, it will protect the bristle head from collecting germs, dust and dirt when not in use.

1 Claim, 1 Drawing Sheet

MODIFIED SANITARY TOOTHBRUSH HOLDER

BACKGROUND OF THE INVENTION

The instant invention relates generally to toothbrush receptacles and more specifically it relates to a sanitary toothbrush holder, which provides a sanitary plastic bag dispensed from a roll to encase the bristle head of a toothbrush. There are available various conventional toothbrush receptacles which do not provide the novel improvements of the invention herein disclosed.

SUMMARY OF THE INVENTION

A primary object of the present invention is to provide a sanitary toothbrush holder that will overcome the shortcomings of the prior art devices.

Another object is to provide a sanitary toothbrush holder in which a sanitary plastic bag dispensed from a roll will encase the bristle head of a toothbrush, so as to protect the bristle head from collecting germs, dust and dirt.

An additional object is to provide a sanitary toothbrush holder that can be mounted to a vertical flat surface, so that the bristle head of the toothbrush can be held within the sanitary plastic bag from the roll carried in the holder.

A further object is to provide a sanitary toothbrush holder that is simple and easy to use.

A still further object is to provide a sanitary toothbrush holder that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
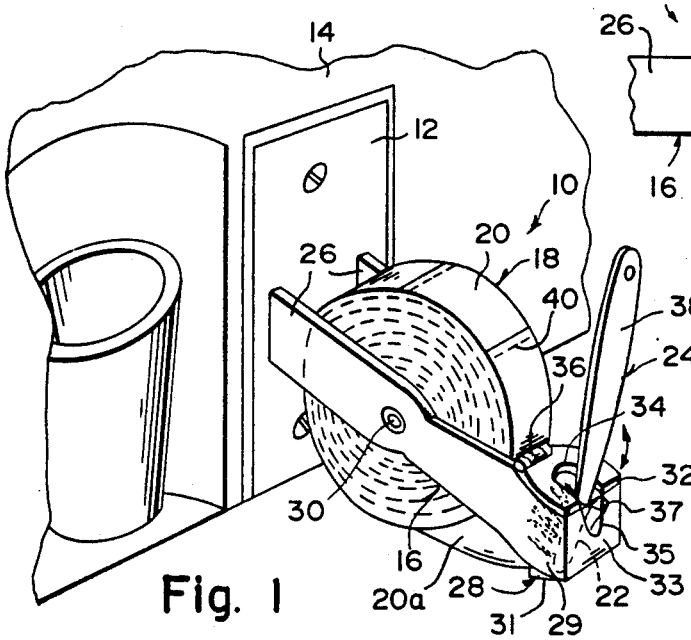
FIG. 1 is a perspective view of the instant invention mounted to a flat vertical surface, showing a bristle head of a toothbrush inserted therein.
Figure 2A:
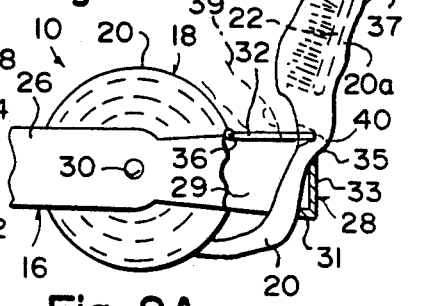
FIG. 2A is a side view similar to FIG. 2, showing the bristle head of the toothbrush with the sanitary bag being removed therefrom.
Figure 3:
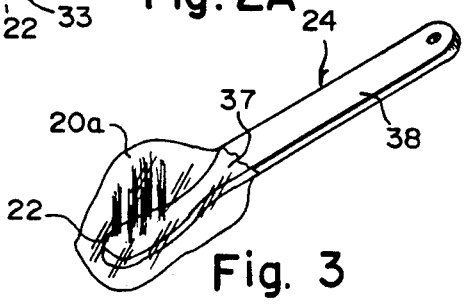
FIG. 3 is a perspective view of the toothbrush showing the bristle head inserted within the sanitary bag removed from the holder.
Figure 2:
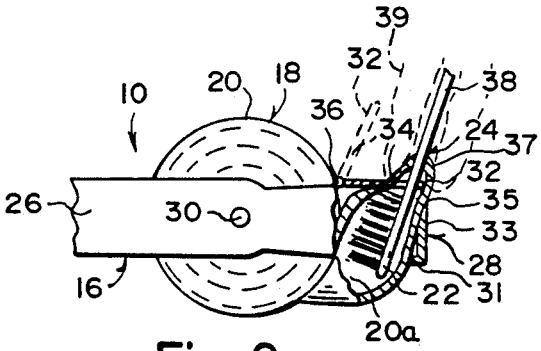
FIG. 2 is a side view similar to FIG. 1A showing the bristle head of the toothbrush in the sanitary bag ready to be pulled therefrom.
Figure 4:
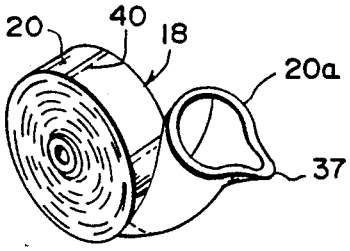
FIG. 4 is a perspective view of the roll of sanitary bags with the first bag opened.

Turning now descriptively to the drawings, in which similar reference characters denote similar elements throughout the several views, FIG. 1 through 2A illustrates a sanitary toothbrush holder 10, which consists of a plate 12 for mounting the holder 10 to a flat vertical surface 14. A bracket 16 extends outwardly form the plate 12. A receptacle 28 is formed on a forward end of the bracket 16. A roll 18 of sanitary disposable plastic bags 20 (see FIG. 4) is rotatably carried in the bracket 16. The leading bag **20*a* can be opened and positioned manually within the receptacle 28, to receive a bristle head 22 of a toothbrush 24. When the leading bag 20*a* with the bristle head 22 of the toothbrush 24 is removed, as shown in FIG. 3, it will protect the bristle head 22** from collecting germs, dust and dirt when not in use.

The bracket 16 includes a pair of arms 26, spaced apart and connected at one end in a side by side parallel relationship to the plate 12. A shaft 30 extends between the pair of arms 26 behind the receptacle 28, to allow the roll 18 of bags 20 to rotate toward the receptacle, so that the leading bag **20*a* can be pulled into the receptacle 28**.

The receptacle 28 contains a pair of side walls 29, integral with the arms 26 of the bracket 16 and have an inside width slightly larger than the width of the roll 18 of bags 20. A bottom wall 31 extends under the side walls 29. A front wall 33 extends across the side walls 29. The front wall 33 has a slot 35 extending downwardly from a top edge. The receptacle 28 will receive the leading bag **20*a* of the roll 18 of bags 20 with a portion 37 of the leading bag 20*a* extending through the slot 35 in the front wall 33 to be gripped by fingers 39** of a person.

A lid 32 has a slot 34 extending inwardly from a forward edge. The lid 32 fits over the top of the receptacle 28 to retain the leading bag **20*a* within the receptacle 28. A hinge 36 is between a rearward edge of the lid 32 and across the top edges of the side walls 29. The lid 32 can be flipped up from the top of the receptacle 28 to receive the bristle head 22 of the toothbrush 24. The lid 32 can then be flipped down to cover the top of the receptacle 28, with the handle 38 of the toothbrush 24 extending through the slot 34 in the lid 32**.

Figure 5:
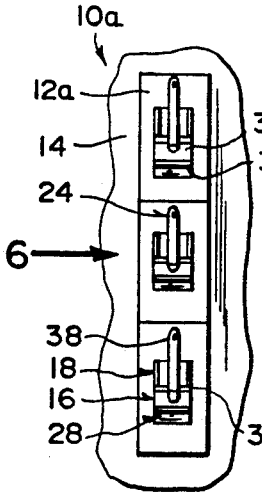
FIG. 5 is a front view of a multiple holder mounted to the flat surface.
Figure 6:
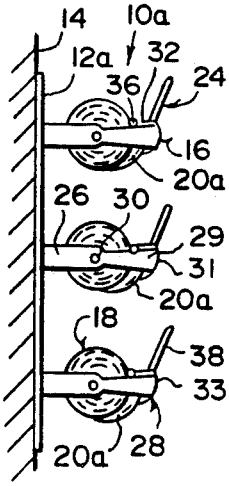
FIG. 6 is a side view taken in direction of arrow 6 in FIG. 5.

FIGS. 5 and 6 show a modified holder **10*a* being an elongated plate 12*a* with a multiple number of brackets 16 positioned one under the other, so that a plurality of toothbrushes 24 can have their bristle heads 22 stored within each leading bag 20*a* in a sanitary condition. Each leading bag 20*a* with its respective toothbrush 24** can also be removed as the need arises.

OPERATION OF THE INVENTION

Figure 1A:
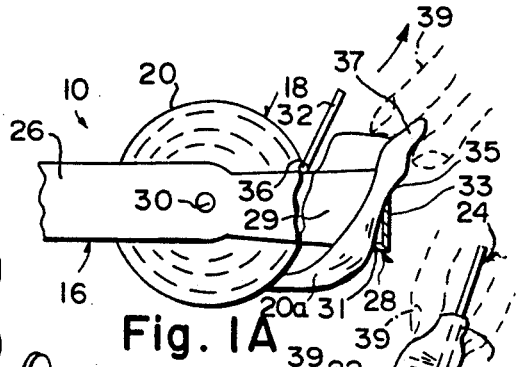
FIG. 1A is a side view with parts broken away showing the first sanitary plastic bag being pulled into position.

To utilize the sanitary toothbrush holder, simply lift up the lid 32, pull the portion 37 of the leading bag **20*a* into the receptacle 28 and open the leading bag, as shown in FIG. 1A. The bristle head 22 of the toothbrush 24 can be inserted within the leading bag 20*a* and the lid 32 closed, as shown in FIG. 1. To remove the leading bag 20*a* with the toothbrush 24, lift up the lid 32 and grip the portion 37 of the leading bag 20*a* with the toothbrush 24 by the fingers 39, as shown in FIG. 2 and pull it out of the receptacle 28. then close the lid 32 and hold it down with a finger 39. The leading bag 20*a* can then be detached from the roll 18 at the tear line 40 as shown in FIG. 2A**.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A sanitary toothbrush holder which comprises:

a) a plate for mounting said holder to a flat vertical surface;

b) a bracket extending outwardly from said plate;

c) a receptacle formed on a forward end of said bracket;

d) a roll of sanitary disposable plastic bags rotatably carried in said bracket, in which a leading bag of said roll of sanitary disposable plastic bags can be opened and positioned manually within said receptacle, adapted to receive a bristle head of a toothbrush, so that when the leading bag with the bristle head of the toothbrush is removed, it will protect the bristle head from collecting germs, dust and dirt when not in use; wherein said bracket includes:

e) a pair of arms, spaced apart and connected at one end in a side by side parallel relationship to said plate;

f) a shaft extending between said pair of arms behind said receptacle to allow said roll of bags to rotate toward said receptacle, so that the leading bag can be pulled into said receptacle; wherein said receptacle includes:

g) a pair of side walls integral with said arms of said bracket and having an inside width slightly larger than the width of said roll of bags;

h) a bottom wall extending under said side walls;

i) a front wall extending across said side walls, said front wall having a slot extending downwardly from a top edge, so that said receptacle will receive the leading bag of said roll of bags with a portion of the leading bag extending through said slot in said front wall to be gripped by fingers of a person; further including:

j) a lid having a slot extending inwardly from a forward edge, whereby said lid fits over the top of said receptacle to retain the leading bag within said receptacle; and k) a hinge between a rearward edge of said lid and across the top edges of said side walls, so that said lid can be flipped up from the top of said receptacle adapted to receive the bristle head of the toothbrush and then flipped down to cover the top of said receptacle with the handle of the toothbrush extending through said slot in said lid.

* * * * *